US005413326A

United States Patent [19]

Wright

[11] Patent Number: 5,413,326

[45] Date of Patent: May 9, 1995

[54] APPARATUS FOR CHANGING THE DIRECTION OF MOTION OF DOCUMENTS

[75] Inventor: William J. Wright, Killingworth, Conn.

[73] Assignee: Pitney Bowes Inc., Stamford, Conn.

[21] Appl. No.: 173,040

[22] Filed: Dec. 27, 1993

[51] Int. Cl.[6] ..... B65H 5/00

[52] U.S. Cl. ..... 271/225; 271/184; 271/248

[58] Field of Search ..... 271/225, 184, 248, 250–252; 198/786, 787, 457, 448

[56] References Cited

U.S. PATENT DOCUMENTS

| | | | |
|---|---|---|---|
| 3,334,723 | 8/1967 | Reed et al. | 198/448 X |
| 4,527,792 | 7/1985 | Burkhardt | 271/225 |
| 4,572,350 | 2/1986 | Besemann | 198/372 |
| 5,180,154 | 1/1993 | Malick | 271/2 |
| 5,180,159 | 1/1993 | Malick | 271/302 |
| 5,188,355 | 2/1993 | Lowell et al. | 271/225 |
| 5,282,528 | 2/1994 | Hudson | 271/225 X |

FOREIGN PATENT DOCUMENTS

| | | | |
|---|---|---|---|
| 872632 | 6/1971 | Canada | 198/448 |
| 1747402 | 7/1992 | U.S.S.R. | 271/225 |

*Primary Examiner*—H. Grant Skaggs
*Assistant Examiner*—Carol L. Druzbick
*Attorney, Agent, or Firm*—Charles R. Malandra, Jr.; Melvin J. Scolnick

[57] ABSTRACT

An apparatus for transporting documents comprises first direction transporting structure for receiving first documents being conveyed seriatim in a first direction and transporting the first documents seriatim in the first direction. Second direction transporting structure is adjacent a downstream end of the first direction transporting structure for transporting the first documents in a second direction which is at an acute angle to the first direction. The second direction transporting structure seizes control of the first documents from the first direction transporting structure and positively transports the first documents in the second direction. Third direction transporting structure is adjacent the second direction transporting structure for transporting the first documents in the third direction after the first documents are released from the control of the second direction transporting structure. The third direction transporting structure includes a receiving end for receiving second documents being conveyed seriatim in the third direction and transporting the second documents in the third direction.

14 Claims, 4 Drawing Sheets

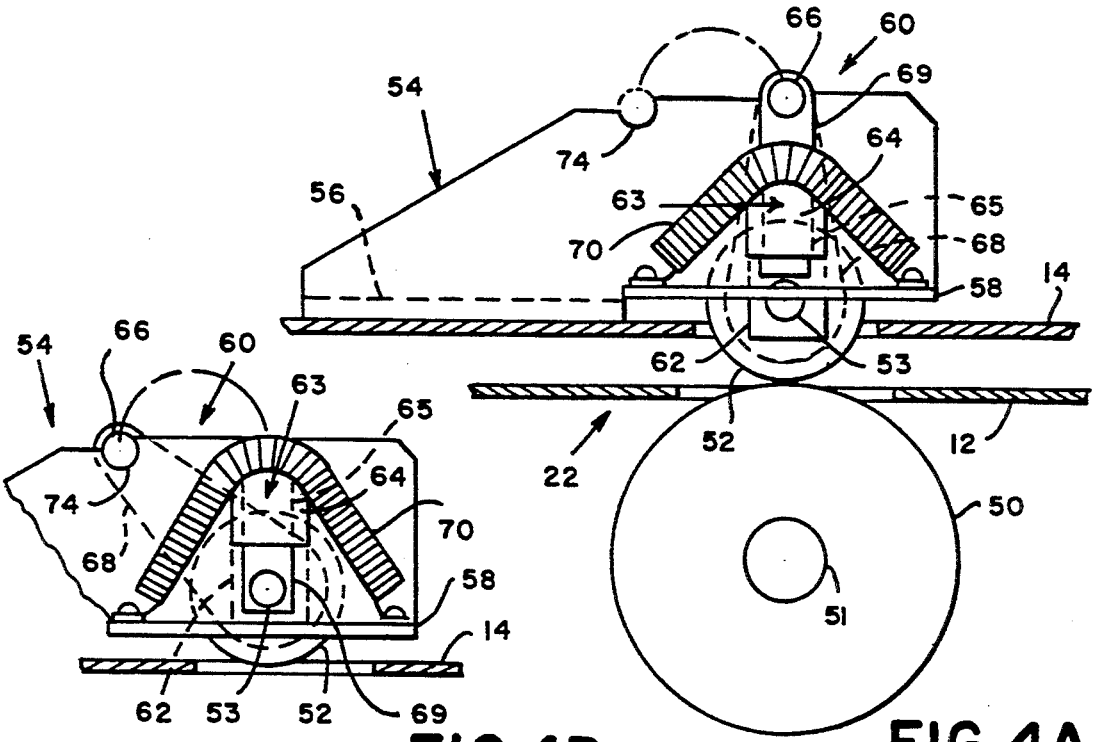
FIG.4A
FIG.4B
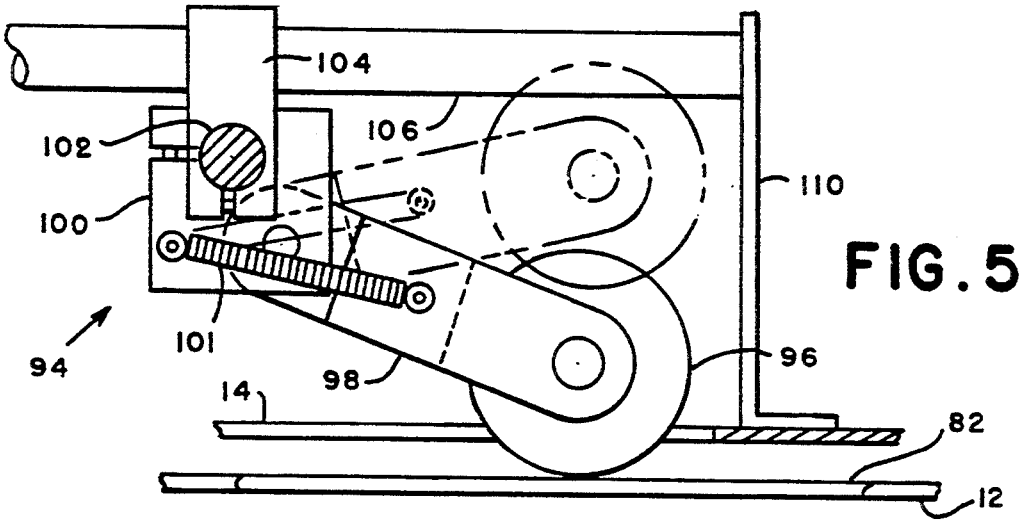
FIG.5
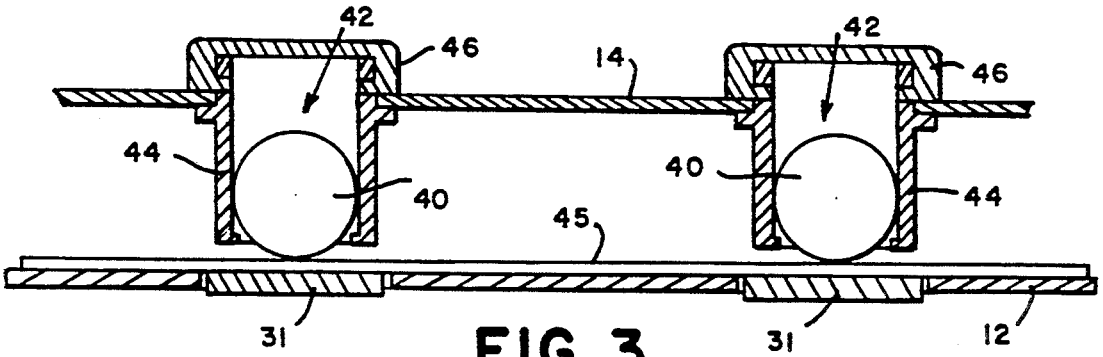
FIG.3

APPARATUS FOR CHANGING THE DIRECTION OF MOTION OF DOCUMENTS

FIELD OF THE INVENTION

The present invention relates generally to apparatus for changing the direction of motion of documents, and more particularly, for changing the direction of motion of documents without turning the documents.

BACKGROUND OF THE INVENTION

Devices are known which turn flat articles such as letter envelopes, within a plane. These devices are required where envelopes are discharged from an inserter and are not properly oriented to be fed to a downstream device such as a franking machine. An inserter is a machine that inserts selected items in an envelope for further processing. The filled envelope is sealed and then conveyed to a franking machine to have postage imprinted thereon. Generally, turner devices have the disadvantage of having to be an integral part of the inserting machine.

Examples of devices which turn flat articles in inserting machines are shown in U.S. Pat. No. 4,726,461 issued Feb. 23, 1988 to J. Pokrinchak and U.S. Pat. No. 4,928,807 issued May 29, 1990 to D. Auerbach, both of which patents are assigned to the assignee of the present invention.

It is known to change the direction of travel for flat articles without changing the orientation of the articles, i.e., without rotating or turning the articles. It is also known that for a one stage right angle change in direction the articles must be stopped in one direction before being conveyed in the right angled direction. Such a device is described in U.S. Pat. No. 4,909,374 issued Mar. 20, 1990 to M. Skrypalle and assigned to the assignee of the present invention.

It is also known that a right angle change of direction for flat articles can be achieved in two or more stages by the use of deflection rollers which change the direction of travel by forty-five degrees (45°) or less at each stage. Such an apparatus and method used in a sorting machine is disclosed in U.S. Pat. No. 4,527,792 issued Jul. 9, 1985 to G. Burkhardt. The Burkhardt apparatus has several limitations which prevent it from being usable in an inserting machine. The apparatus is limited to changing direction of travel from a path parallel to a long edge of the mailpiece to a path of travel parallel to the short edge thereof. Furthermore, for all sized mailpieces, the Burkhardt apparatus requires a side-justified line of travel along the first direction of travel so that the deflection rollers can engage the article at the right moment to achieve an accurate change in direction. Typically, in an inserter, the center line of travel of the mailpiece is fixed with the side guides being adjustable for handling various sized mailpieces.

Several improvements in the throughput of various upstream modules (such as feeders, accumulators and insert stations) have raised the expectation that the output of inserting machine would keep up with such improvements. However, when the output was increased on inserters that included conventional turner devices, problems were experienced because the turner devices were unable to reliably maintain the increased output rate. For example, inserts were flying out of envelopes before the flap could be closed. Also, turner components were malfunctioning more frequently.

In U.S. Pat. No. 5,180,154, issued on Jan. 19, 1993 to S. Malick and assigned to the assignee of the present invention, a method and apparatus is disclosed for a right angle transfer device for conveying flat articles. The apparatus includes a deck having a first side for receiving an article from a first direction and a second direction which forms an acute angle equal to or less than forty-five degrees (45°) with the first direction. There is a structure which includes a plurality of angled roller pairs for conveying the article over the deck in the second direction. The conveying structure engages a leading edge of the article only after the article has been disengaged by a conveying structure in the first direction. There is a registration wall positioned downstream from the second direction conveying structure adjacent a third side of the deck. The registration wall extends a third direction whereby the registration wall is at a right angle to the first direction, wherein the leading edge of the article is driven against the registration wall after the article has been disengaged by the second direction conveying structure. There is a structure for conveying the article in the third direction after the article is against said registration wall.

U.S. Pat. No. 5,180,159, issued on Jan. 19, 1993 to S. Malick and assigned to the assignee of the present invention, provides an adjustable right angle transfer apparatus for conveying flat articles in one of two directions. The apparatus is similar to the Malick '154 apparatus but the angled roller pairs for conveying in a second direction are mounted on a circular deck that can be rotated to position the rollers for conveying forty-five degrees to the left or to the right.

In U.S. patent application Ser. No. 732,862, filed on Jul. 19, 1991 and assigned to the assignee of the present invention, a method and apparatus is disclosed for aligning while changing the direction of motion of flat articles being conveyed along a first path to a second path. The apparatus includes an adjustable registration wall in combination with an angled roller assembly that perform the dual function of conveying the article in the third direction and aligning the article against the registration wall. This apparatus when used with a right angle transfer device, such as in Malick '154 or '159, solved registration problems, such as the article crashing into the registration wall and rebounding away from the wall while being conveyed at high speed in the third direction.

The foregoing apparatus are configured for handling documents of a particular size, such as envelopes or sheets of paper. Although the foregoing apparatus works well for handling single size documents, they lack adjustment capability needed for handling multiple size documents. Typically, the foregoing apparatus requires the addition or removal of rollers angled at 45° when the apparatus is used to handle larger or smaller documents respectively. Furthermore, the foregoing apparatus do not include a path for straight through processing in the third direction.

It is an object of the present invention to provide a transport apparatus for changing the direction of motion of any size document.

It is a further object of the present invention to provide a transport apparatus that can transport documents from either of two inputs sections to a single output section.

SUMMARY OF THE INVENTION

The present invention provides an apparatus for receiving individual documents conveyed along a first path and without turning the documents conveying the documents in a second direction that is orthogonal to the first direction. Conventionally, this is known as transporting from landscape to portrait or portrait to landscape. The present invention performs such change in direction transporting at high speed while maintaining a constant gap between the documents. The apparatus also includes a path in the second direction for straight through processing.

In accordance with the present invention, an apparatus for transporting documents comprises first direction transporting means for receiving first documents being conveyed seriatim in a first direction and transporting the first documents seriatim in the first direction. Second direction transporting means are adjacent a downstream end of the first direction transporting means for transporting the first documents in a second direction which is at an acute angle to the first direction. The second direction transporting means seize control of the first documents from the first direction transporting means and positively transport the first documents in the second direction. Third direction transporting means are adjacent the second direction transporting means for transporting the first documents in the third direction after the first documents are released from the control of the second direction transporting means. The third direction transporting means include a receiving end for receiving second documents being conveyed seriatim in the third direction and transporting the second documents in the third direction.

The apparatus further includes a deck having a first input end for receiving the first documents being conveyed in the first direction, a second input end for receiving the second documents being conveyed in the third direction and an exit end to which the third direction transport means transports the first and second documents in the third direction.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 3 is a side sectional view of the input transport of the apparatus of FIG. 1 taken along the lines 3—3;

FIG. 4A is a side sectional view of the forty-five degree transport rollers of the apparatus of FIG. 1 taken along the lines 4—4;

FIG. 4B is a side sectional view similar to FIG. 4A but with the upper roller in a raised position;

FIG. 5 is a side sectional view of the biased idler rollers for the output transport of the apparatus of FIG. 1 taken along the lines 5—5.

DETAILED DESCRIPTION OF THE PRESENT INVENTION

Figure 1:
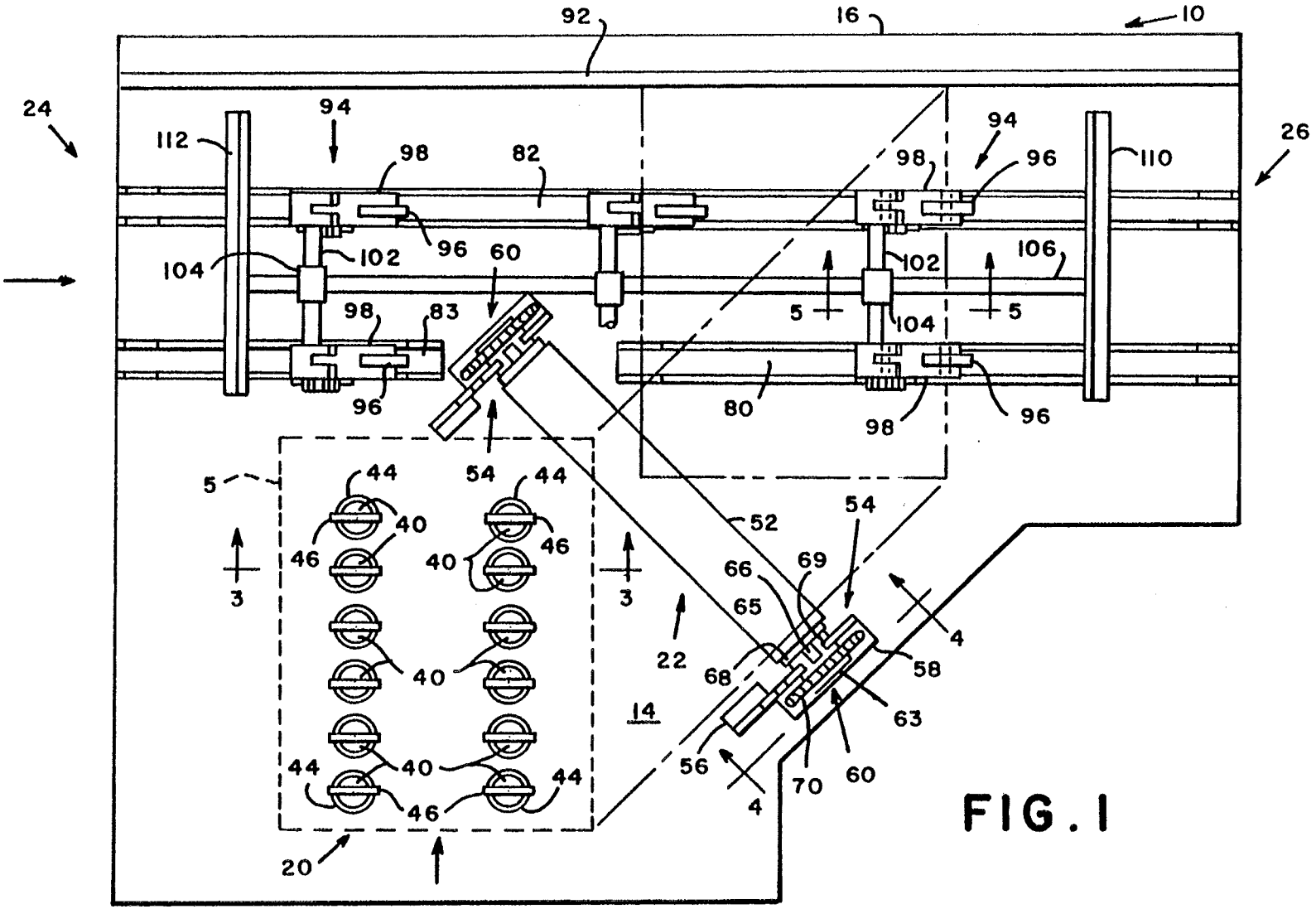
FIG. 1 is a plan view of an apparatus for changing the direction motion of documents in accordance with the present invention.

In describing the preferred embodiment of the present invention, reference is made to the drawings, wherein there is seen in FIGS. 1–5 an apparatus, generally designated 10, for changing the direction of motion of documents. The apparatus includes a lower deck 12 and a similarly shaped upper deck plate 14. In the preferred embodiment of the present invention deck 12 and upper deck plate 14 are machined sheet metal, however upper deck plate 14 can be a clear plastic material with a low coefficient of friction, such as Lexan. Upper deck plate 14 is pivotally mounted in a conventional manner (not shown) to lower deck 12 at a rear side 16 for jam clearance.

Apparatus 10 includes a first input section, generally designated 20, a transfer section, generally designated 22, a second input section, generally designated 24, and an output section, generally designated 26. In accordance with the present invention, apparatus 10 transports individual documents 5 having a portrait orientation at first input section 20 through transfer section 22 and outputs the document 5 at output section 26 with the document in a landscape orientation. (It will be understood that apparatus 10 could also transport documents from landscape to portrait). Apparatus 10 can also transport documents from second input section 24 straight through to output section 26.

First input section 20 includes a pair of conventional endless, flat transport belts 30 each of which has an upper reach 31 that extends through a slot in deck 12. Upper reach 31 for each belt 30 is slightly higher than deck 12. Each belt 30 travels around a driven pulley 32 and an idler pulley 34. A normal force is applied to each belt 30 such that documents 5 do not slip while being transported by belts 30. In the preferred embodiment, the normal force is applied by a plurality of steel balls 40 mounted within holes, generally designated 42, in upper deck plate 14. As seen in FIGS. 1 and 3, six steel balls are supported above the length of each belt 30 by ball cups 44 which have an interior cavity sized to allow ball 40 to freely rotate and move up and down so as to apply a normal force against documents 5 being transported without impeding the advancement of the documents. The lower end of ball cups 44 have a diameter slightly smaller than steel balls 40. Ball cups 44 have an outer ridge section that rests against the underside of upper deck plate 14. Ball cups 44 are secured within holes 42 by means of clips 46 which snap into slots in ball cups 44, which extend above upper deck plate 14. It will be understood that the normal force could be applied by other conventional means such as biased idler rollers.

Transfer section 22 includes a lower driven roller 50 and an upper idler roller 52. Rollers 50 and 52 are mounted at an acute angle to input belts 30. As seen in FIG. 1, in the preferred embodiment this angle is forty-five degrees (45°). Lower roller 50 secured to shaft 51 which is rotatably mounted to the underside of deck 12 in a conventional manner (not shown). Upper roller 52 is rotatably mounted to a shaft 53 that is mounted at each end to a bracket assembly, generally designated 54. Bracket assemblies 54 are mounted to the topside of upper deck plate 14. Upper roller 52 extends through a slot in upper deck plate 14. Each bracket assembly 54 includes a mounting leg member 56 that is secured to deck plate 14, and a raised leg member 58 which clears the topside of deck plate 14. Each bracket assembly 54 further includes a mechanism, generally designated 60, for retracting upper roller 52 from lower roller 50. Each retracting mechanism 60 includes a slide member, generally designated 63, having a long arm 62 and a short arm 64 with a narrow beam 65 therebetween. Beam 65 slidably fits within a slot 69 bracket assembly 54 such that long arm 62 is adjacent the inner side of bracket assembly facing roller 52 and short arm 64 is adjacent the outer side of bracket assembly 54. In this manner, slide member 63 is moveable up and down slot 69. Shaft 53 is mounted to the lower end of each long arm 62. The lower end of short arm 64 acts as a relief against raised leg member 58. A spring 70 is mounted over short arm 64 and fastened at each end to raised leg member 58 in each bracket assembly 54. In this manner slide member 63 is urged toward raised leg member 58 and thus biases upper roller 52 against lower roller 50. Each retracting mechanism 60 further includes a pivoting arm member 68 adjacent long arm 62. Shaft 53 is pivotally mounted to the lower end of pivoting arm 68. The upper end of pivoting arm 68 has a pin 66 extending therefrom.

When upper roller 52 is in its normal operating position, i.e., biased against lower roller 50, pin 66 extends through slot 69 (FIG. 4A). Upper roller 52 is locked in a raised position by moving pin 66 to a notch 74 in bracket assembly 54, causing pivoting arm 68 to raise shaft 53 as slide member 63 moves up slot 69 (FIG. 4B).

The tension of springs 70 must be adequate so that rollers 50 and 52 seize document 5 from first input section 20 and maintain the orientation of the document as it is conveyed forty five degrees (45°) to output section 26. In the preferred embodiment of the present invention a spring force of approximately two and one half pounds per spring is used. In accordance with the present invention the use of a single pair of rollers 50 and 52 angled forty-five degrees to first input section is possible because the rollers seize complete control of the document from the moment the leading corner of document 5 enters the nip of rollers 50 and 52. It will be understood by those skilled in the art that the normal force applied by steel balls 40 to belts 30 must be sufficiently less than the normal force applied by upper roller 52 to lower roller 50 so that the first input section 20 yields control of document 5 to transfer section 22.

When documents are being transported from second input section 24 to output section 26, upper roller 52 must be retracted so that it does not interfere with such straight through conveyance. As previously described, upper roller 52 is retracted by sliding pin 66 to notch 74 in bracket assembly 54. When pin 66 in locked in notch 74, upper roller is raised away from lower roller 50 sufficiently to allow documents to pass unimpeded.

Output section 26 includes a pair of lower, endless belts 80 and 82 traveling in a direction orthogonal to the travel of input belts 30. Belt 80 extends from the output end of apparatus 10 to just short of rollers 50 and 52. Belt 82 extends from the output end to input section 24. Belts 80 and 82 respectively travel around driven pulleys 84 and 86 and idler pulleys 88 and 90 which are rotatably mounted to the underside of deck 12 in a conventional manner. The upper reach of belts 80 and 82 extend through slots in deck 12.

A registration wall 92 is adjustably positioned slightly more than one sheet length from the nip of rollers 50 and 52 such that document 5 does not hit against registration wall 92 until it has been release by rollers 50 and 52. The registration wall is adjustably positioned in a conventional manner, for example, by mounting the registration wall 92 to deck plate 14 by screws extending through slots in the deck plate 14 (not shown).

A pair of upper output belts 124 are opposed to the downstream end of belts 80 and 82 to assist in moving document 5 downstream for further processing.

Second input section 24 includes belt 82 and a short, endless flat belt 83 which extends from second input section 24 to just short of rollers 50 and 52. The upper reach of belts 83 extends through a slot in deck 12.

Referring now to FIGS. 1 and 5, a plurality of idler roller pair assemblies, generally designated 94, are adjustably positioned above belts 80, 82 and 83 to provide a normal force against the belts. Roller pair assemblies 94 include a pair of rollers 96, each of which is rotatably mounted to an arm 98 which in turn is pivotally mounted to a plate 100. Each plate 100 is secured to an end of a transverse bar 102 that is secured to a center bracket 104. Center bracket 104 is adjustably secured to a horizontal bar 106 that extends between belts 80 and 82 at the output end and between belts 82 and 83 at the second input end. At the output end, bar 104 is mounted in a raised position above upper deck plate 14 to the top end of bracket 110. The lower end of bracket 110 is mounted to the topside of upper deck plate 14. Similarly, the other end of bar 106 is mounted to bracket 112. Idler roller pair assemblies 94 are evenly spaced so as to be less than one sheet length apart for controlling documents from second input section 24 to output section 26.

Each idler roller pair assembly 94 includes a conventional over center linkage comprising a spring 101 fastened at one end to plate 100 and at the other end to arm 98. The over center linkage allows idler rollers 96 to be locked in a raised position. When documents are being transported from first input section 20 it is critical that idler rollers 96 do not engage document 5 until it has been released by rollers 50 and 52. Thus in accordance with the present invention, all idler roller 96 are raised except for the rollers in the last idler roller pair assembly 94 at the output section 26. In this manner output section 26 does not take control of document 5 until transfer section 22 has released control of the document.

Figure 2:
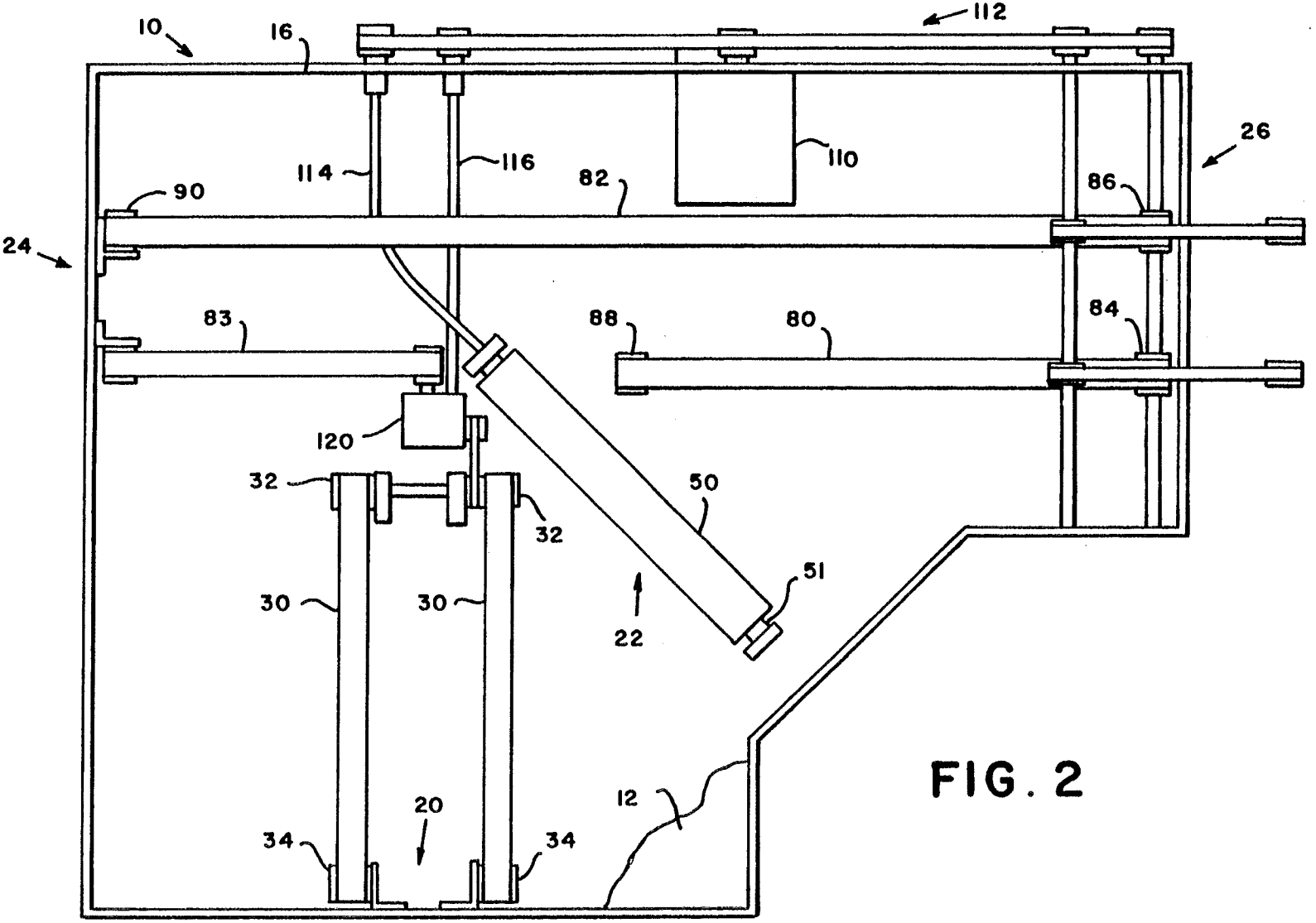
FIG. 2 is a plan sectional view of the deck, belts and lower roller and the drives therefor of the apparatus of FIG. 1.

Referring now to FIG. 2, the drive system for the present invention that drives the entire apparatus is shown. A motor 110 drives a conventional belt and pulley system, generally designated 112, which in turn drives driven pulleys 84 and 86 which move belts 80 and 82. Drive system 112 also drives roller 50 by way of flexible shaft 114. Drive system 112 also drives a conventional gear box 120 by way of shaft 116. Gear box 120 drives second input belt 83 and pulleys 32 which move first input belts 30. Drive system 112 also drives pulleys 122 which move upper output belts 124. Drive system 112 is configured such that document 5 moves through apparatus 10 at a constant speed.

Figure 6:
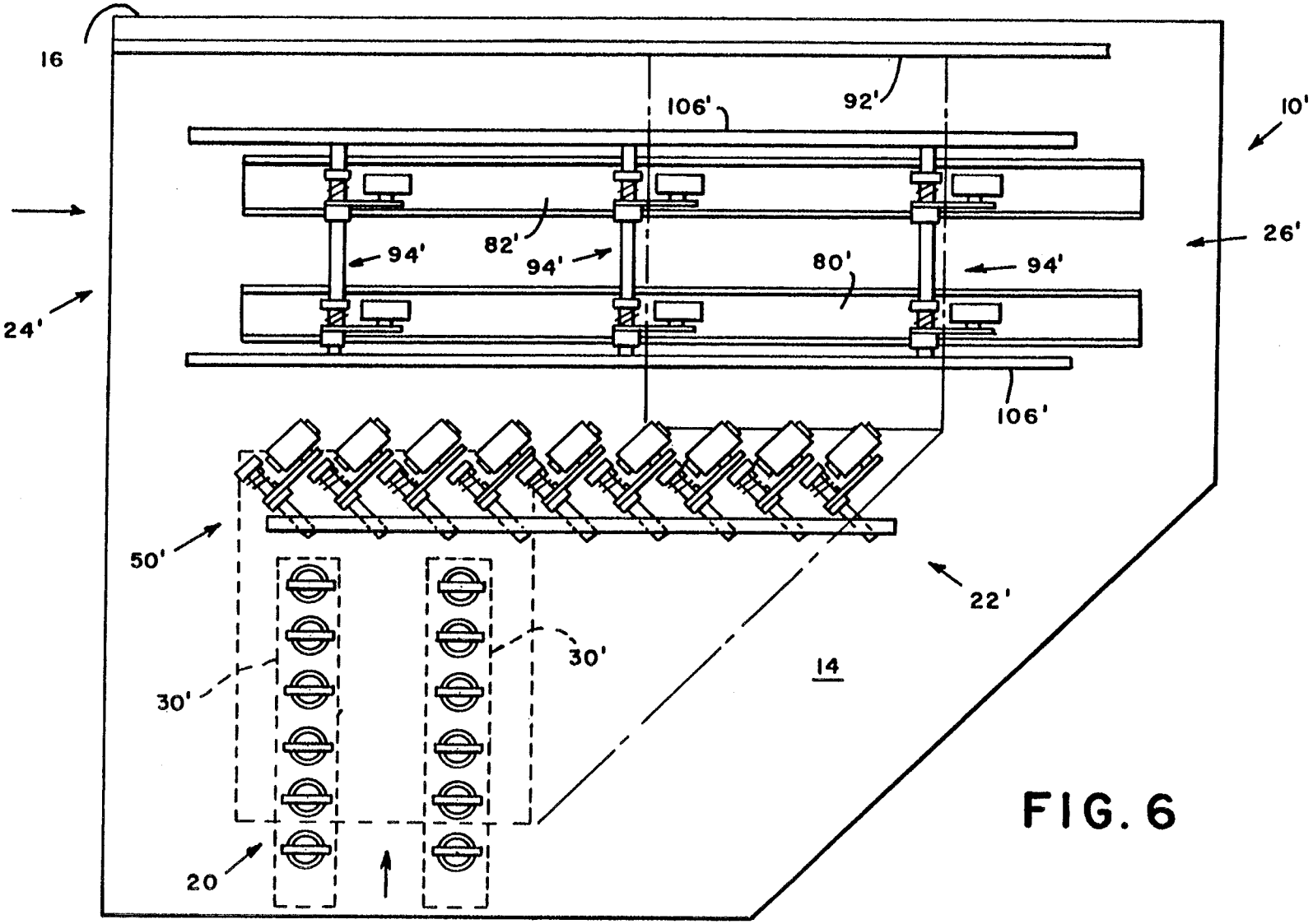
FIG. 6 is a plan view of an alternate embodiment of an apparatus for changing the direction motion of documents in accordance with the present invention.

Referring now to FIG. 6, an alternate embodiment to the present invention is shown. The first input section 20' is identical to the first input section 20 described for the preferred embodiment.

The second input section 24' and output section 26' are similar to their counterparts in the preferred embodiment. Instead of one of two shorter belts 80 and 83, there is one belt 80' that extends the same length as belt 82'. Also shown, is an alternate bracket assembly 106' for adjustably mounting roller pair assemblies 94'.

The main difference in the alternate embodiment is found in transfer section 22'. Instead of one pair of rollers angled at forty-five degrees to first input section belts, there are a plurality of roller pairs 50' that are each angled at forty-five degrees to the first input belts 30'. Roller pairs 50' are positioned such that a line extending through the nip of each roller is perpendicular to first input belts 30'. The lower rollers (not shown) of roller pairs 50 are driven by a separate conventional staggered belt and pulley system (not shown). Thus, as shown in FIG. 6, transfer section 22' seizes the entire leading edge of document 5 as it takes control of document 5 from first input section 20. As a result, the alternate embodiment provides more control over the document when the transfer section begins the change the direction of motion of the document. However, it will be understood that the alternate embodiment provides more control at the expense of a more complex apparatus. It has been found that the preferred embodiment is suitable for most normal applications.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. An apparatus for transporting documents, comprising:

first direction transporting means for receiving first documents being conveyed seriatim in a first direction and transporting the first documents seriatim in said first direction;

second direction transporting means adjacent a downstream end of said first direction transporting means for transporting the first documents in a second direction which is at an acute angle to said first direction, said second direction transporting means seizing control of said first documents from said first direction transporting means and positively transporting the first documents in said second direction;

third direction transporting means adjacent the said second direction transporting means for transporting the first documents in said third direction after the first documents are released from the control of said second direction transporting means, said third direction transporting means including a receiving end for receiving second documents being conveyed seriatim in said third direction and transporting said second documents in said third direction;

a deck having a first input end upstream to said first direction transporting means for receiving the first documents being conveyed in said first direction, a second input end upstream to said third direction transporting means for receiving the second documents being conveyed in the third direction and an exit end to which said third direction transport means transports the first and second documents in said third direction; and a registration wall extending in said third direction between said second input end to said exit end wherein said registration wall is adjustably positioned relative to said second direction transporting means such that the first documents first hit against said registration wall after the first documents are released from the control of said second direction transporting means.

2. The apparatus of claim 1 wherein said first direction transporting means include a pair of endless belts, each of said belts having an upper reach moving in said first direction, and means for applying a normal force against said upper reach of said first direction moving belts.

3. The apparatus of claim 1 wherein said second direction transporting means includes an idler roller biased against a driven roller, said idler and driven rollers being angled in said second direction.

4. The apparatus of claim 3 wherein said idler roller is pivotable to a raised, locked position whereby said second direction transporting means does not interfere with said second documents being transported in said third direction after having been received at said receiving end of said third direction transporting means.

5. The apparatus of claim 1 wherein said third direction transporting means include a pair of endless belts, each of said belts having an upper reach moving in said third direction, and means for applying a normal force against said upper reach of said third direction moving belts.

6. The apparatus of claim 1 wherein said second direction transporting means include a plurality of idler rollers biased against a corresponding plurality of driven rollers, each of said rollers being angled in said second direction.

7. The apparatus of claim 1 wherein said second direction is approximately 45 degrees from said first direction and said third direction is ninety degrees from said first direction.

8. The apparatus of claim 1 further including a motor coupled to a drive assembly for driving each of said first, second and third direction transporting means.

9. An apparatus for transporting documents, comprising:

first direction transporting means for receiving documents being conveyed seriatim in a first direction and transporting the first documents seriatim in said first direction;

second direction transporting means adjacent a downstream end of said first direction transporting means for transporting the first documents in a second direction which is at an acute angle to said first direction, said second direction transporting means seizing control of said first documents from said first direction transporting means and positively transporting the first documents in said second direction;

third direction transporting means adjacent the said second direction transporting means for transporting the documents in said third direction after the first documents are released from the control of said second direction transporting means; and a registration wall extending in said third direction adjacent said third direction transporting means wherein said registration wall is adjustably positioned relative to said second direction transporting means such that the first documents first hit against said registration wall after the first documents are released from the control of said second direction transporting means, wherein said first direction transporting means include a pair of endless belts, each of said belts having an upper reach moving in said first direction, and means for applying a normal force against said upper reach of said first direction moving belts.

10. The apparatus of claim 9 wherein said second direction transporting means includes an idler roller biased against a driven roller, said idler and driven rollers being angled in said second direction.

11. The apparatus of claim 9 wherein said third direction transporting means include a pair of endless belts, each of said belts having an upper reach moving in said third direction, and means for applying a normal force against said upper reach of said third direction moving belts.

12. The apparatus of claim 9 wherein said second direction transporting means include a plurality of idler rollers biased against a corresponding plurality of driven rollers, each of said rollers being angled in said second direction.

13. The apparatus of claim 9 wherein said second direction is approximately 45 degrees from said first direction and said third direction is ninety degrees from said first direction.

14. The apparatus of claim 9 further including a motor coupled to a drive assembly for driving each of said first, second and third direction transporting means.

* * * * *